US009643694B2

(12) United States Patent
Geislinger et al.

(10) Patent No.: US 9,643,694 B2
(45) Date of Patent: May 9, 2017

(54) HYDROFOIL FIN

(71) Applicant: Ellergon Antriebstechnik Gesellschaft m.b.H., Hallwang (AT)

(72) Inventors: Cornelius Geislinger, Hallwang (AT); Matthias Geislinger, Hallwang (AT)

(73) Assignee: Ellergon Antriebstechnik Gesellschaft M.B.H., Hallwang (AT)

( * ) Notice: Subject to any disclaimer, the term of this patent is extended or adjusted under 35 U.S.C. 154(b) by 0 days.

(21) Appl. No.: 15/059,402

(22) Filed: Mar. 3, 2016

(65) Prior Publication Data

US 2016/0257382 A1 Sep. 8, 2016

(30) Foreign Application Priority Data

Mar. 3, 2015 (DE) ..... 10 2015 103 021

(51) Int. Cl.
*B63B 35/00* (2006.01)
*B63B 35/79* (2006.01)
*B63B 1/24* (2006.01)

(52) U.S. Cl.
CPC ..... *B63B 35/7923* (2013.01); *B63B 1/248* (2013.01); *B63B 35/7926* (2013.01)

(58) Field of Classification Search
CPC .. B63B 35/7923; B63B 35/7926; B63B 1/248
See application file for complete search history.

(56) References Cited

U.S. PATENT DOCUMENTS

| | | | | |
|---|---|---|---|---|
| 3,669,589 | A | 6/1972 | Bordat | |
| 5,211,594 | A | 5/1993 | Barrows | |
| 5,489,228 | A * | 2/1996 | Richardson | B63B 35/7909 114/357 |
| 5,934,961 | A * | 8/1999 | Mehrmann | B63B 35/7909 441/65 |
| 2013/0244514 | A1 | 9/2013 | Scott et al. | |
| 2015/0017850 | A1 | 1/2015 | Modica et al. | |
| 2015/0239207 | A1* | 8/2015 | Selyugin | B29C 70/543 428/113 |

FOREIGN PATENT DOCUMENTS

| | | | |
|---|---|---|---|
| DE | 3334653 | A1 | 4/1985 |
| DE | 4128957 | A1 | 3/1993 |
| EP | 0041160 | A1 | 12/1981 |
| JP | 10071987 | A | 3/1998 |

(Continued)

OTHER PUBLICATIONS

German Search Report, completed on Nov. 11, 2015, for DE 10 2015 103 021.7.

(Continued)

*Primary Examiner* — Stephen Avila
(74) *Attorney, Agent, or Firm* — Myers Wolin, LLC

(57) ABSTRACT

A hydrofoil fin for attachment to a board for kiteboarding or jet skiing comprises a core portion having a plurality of torsion boxes and outer shell made of a multi-layer fiber composite material and encapsulating the torsion boxes of the core portion. The hydrofoil fin provides a very rigid support of bending and torsional forces acting on the same and on the wings and against the board. This has an advantageous effect on the riding performance of during kite surfing and jet skiing.

10 Claims, 4 Drawing Sheets

(56) References Cited

FOREIGN PATENT DOCUMENTS

| | | | |
|---|---|---|---|
| JP | 10071988 | A | 3/1998 |
| WO | 87/01345 | A1 | 3/1987 |
| WO | 2013177612 | A1 | 12/2013 |

OTHER PUBLICATIONS

Patent Examination Report No. 1 issued for corresponding Australian Patent Application No. 2016200520 issued on May 9, 2016.
German search report issued for corresponding German Patent Application No. 16154572.8 dated Sep. 12, 2016 with an English translation of the relevant part.

* cited by examiner

HYDROFOIL FIN

CROSS REFERENCE TO RELATED APPLICATIONS

This application claims priority under 35 USC §119 to German Patent Application No. DE 10 2015 103 021.7, filed on Mar. 3, 2015, the contents of which are incorporated herein by reference.

FIELD OF THE INVENTION

The invention relates to a hydrofoil fin for attachment to a board. Furthermore, the invention relates to a hydrofoil having a hydrofoil fin.

BACKGROUND

Hydrofoils allow lifting the board out of the water during kite surfing or jet skiing, thereby reducing the flow resistance. They generally comprise a keel fin, hereinafter also referred to as hydrofoil fin, having a first end portion for attachment to the board and a front wing and rear wing, which are arranged one behind the other in the direction of travel and connected to a second end portion of the keel fin. If the board raises from the water only a portion of hydrofoil fin and the two wings remain immersed in the water. In this situation, large bending and torsional moments may occur at the hydrofoil fin.

The object of the invention is to provide a hydrofoil fin which has a low weight and at the same time high flexural and torsional stiffness.

SUMMARY

This object is achieved by a hydrofoil fin according to the claims. This hydrofoil fin particularly includes a core portion formed by a plurality of torsion boxes; and an outer shell made of a layered fiber composite material and surrounding the core portion including said torsion boxes.

The torsion boxes may, for example, have walls made of fiber composite material in order to achieve an especially lightweight and rigid construction.

According to a further advantageous embodiment, the torsion boxes each have four walls made of a layered fiber composite material and extending in longitudinal direction of the hydrofoil fin. Further, the direction of the fibers in at least one of the layers of the fiber composite material is at a first angle to the longitudinal direction of the hydrofoil fin and the direction of the fibers in at least one other of the layers is at a second angle to the longitudinal direction of the hydrofoil fin so that the respective fibers cross each other.

Further, layers having positive and negative angles of incidence to the longitudinal direction may be arranged alternately with respect to each other.

With regard to a particularly low weight, the torsion boxes may be formed as hollow chambers. However, it is also possible to use torsion boxes that are filled with a form material.

For example, the torsion boxes can be configured as foam profiles wrapped by fiber layers with intersecting fiber directions. The foam profiles may thus form during production cores for the windings of the fibers.

Further, at least two torsion boxes may be provided having a different cross-section in a plane transverse to the longitudinal direction of the hydrofoil fin.

According to a further advantageous embodiment the outer shell made of multi-layer fiber composite material may comprise at least one layer having a fiber direction in longitudinal direction of the hydrofoil fin.

Further, the outer shell may comprise additional layers having fiber directions which are angled to the longitudinal direction and cross each other.

According to a further advantageous embodiment, the hydrofoil fin has a mounting portion for coupling to a board. Here, the core portion including the torsion boxes extends into to the mounting portion to allow an optimal connection of the hydrofoil fin to the board and to achieve a further increase in flexural and torsional stiffness.

BRIEF DESCRIPTION OF THE DRAWINGS

In the following the invention will be explained further with reference to an embodiment shown in the drawing. The drawings show in.

DETAILED DESCRIPTION OF THE PREFERRED EMBODIMENTS

Figure 1:
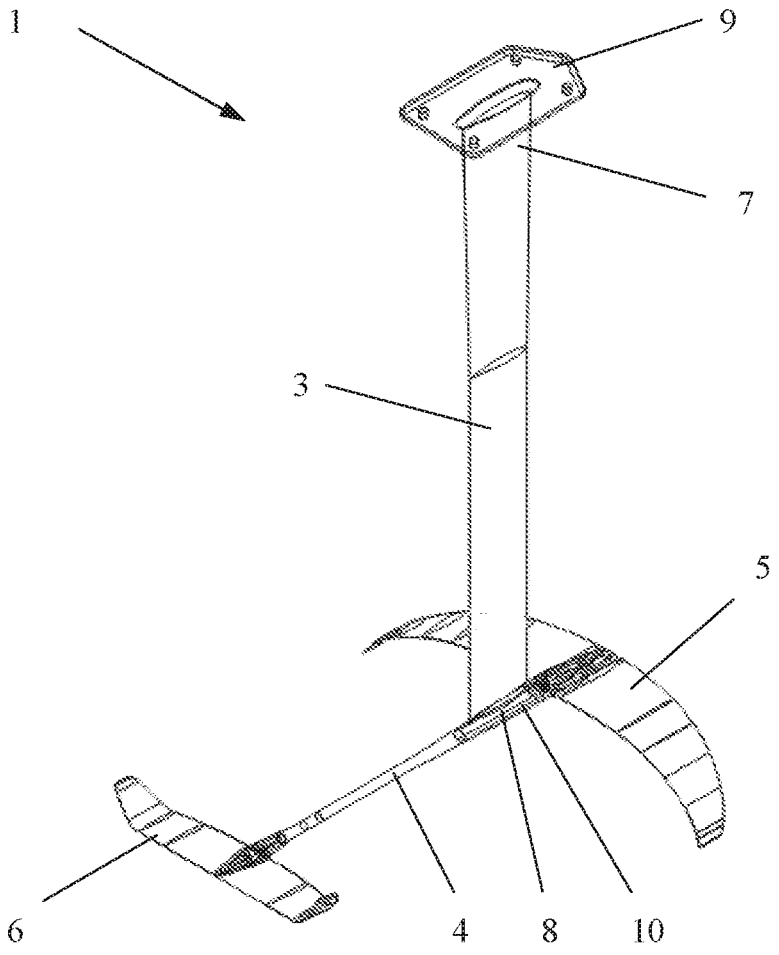
FIG. 1, a perspective view of a hydrofoil according to one embodiment of the invention, FIG. 2, a diagram illustrating the attachment of the hydrofoils to a board, FIG. 3, a sectional view of the hydrofoil fin along the line in FIG. 2, FIG. 4, a schematic representation of the core portion of the hydrofoil fin having a plurality of torsion boxes, and in FIG. 5, a schematic representation of a torsion box.
Figure 2:
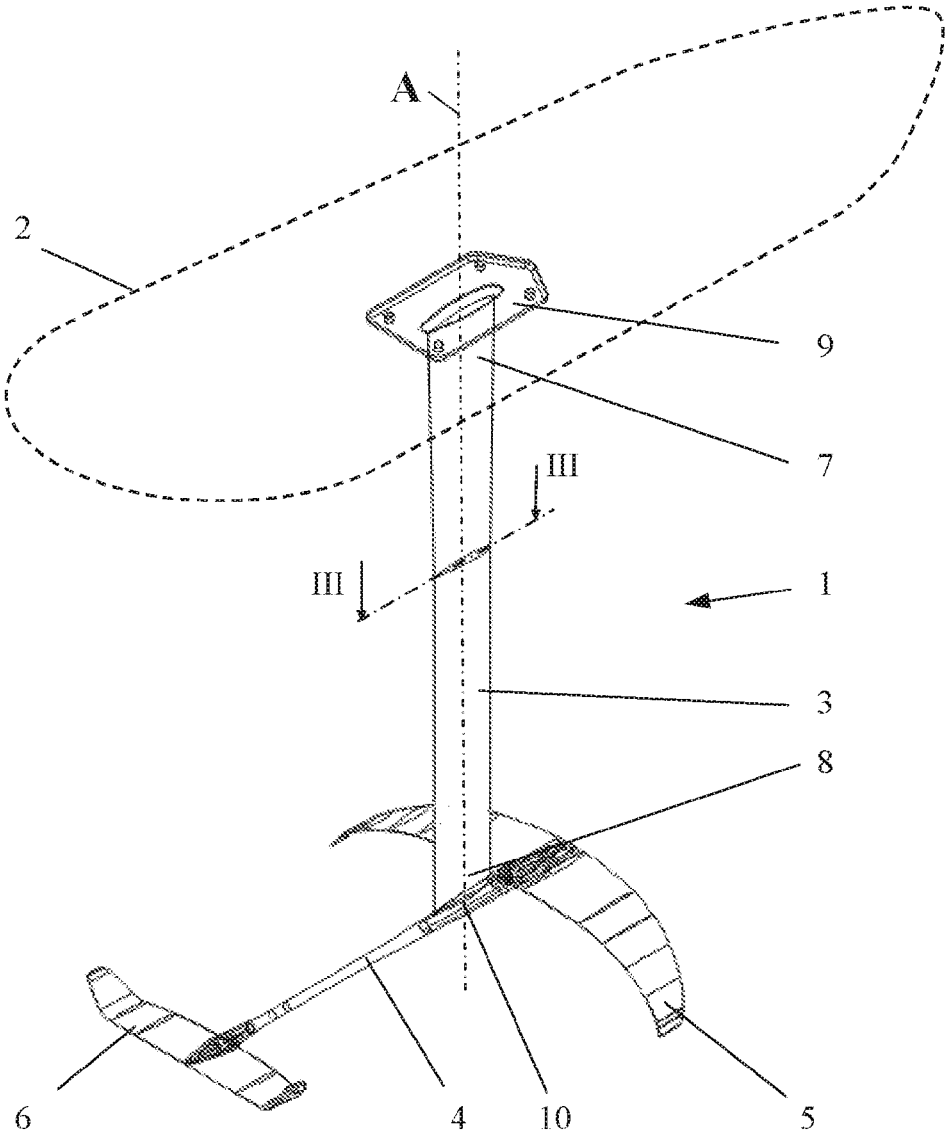

The embodiment shows a hydrofoil 1 for attachment to a board 2 that is suitable for kite surfing and jet skiing.

The hydrofoil 1 includes a keel fin, hereinafter also referred to as hydrofoil fin 3, a connecting rod 4, i.e. fuselage, a front wing 5 and a rear wing 6. These components may be releasably connected together so that they can be exchanged individually. However, it is also possible to combine two or more of the above-mentioned components in a permanent one-piece component in an inseparable manner.

The hydrofoil fin 3 has a first end portion 7 for mounting to the board 2 and a second end portion 8 for attachment of the connecting rod 4. The hydrofoil fin 3 is formed rod or bar-shaped and has a streamlined cross-sectional profile (see FIG. 3). The hydrofoil fin 3 has in its longitudinal direction A a height of about 400 to 1200 mm. The cross-sectional profile has a largest width of about 5 to 20 mm and a length in the direction of travel of about 50 to 200 mm.

The first end portion 7 may have a mounting portion 9 that broadens into a flange to form a supporting surface for the bottom of the board 2, which is enlarged as compared to the remaining cross-section of the hydrofoil fin 3. It is also possible to insert the hydrofoil fin 3 through the board 2 so that the flange shaped mounting portion 9 rests on top of the board 2. Further, it is possible to form a receiving opening in the board 2 in which an end portion 7 of the hydrofoil fin 3 is received positively. A flange shaped extension on the mounting portion 9 may be omitted in this case.

The second end portion 8 of the hydrofoil fin 3 has a receptacle 10 for the connecting rod 4. Via the connecting rod 4, the front wings 5 and the rear wings 6 are fixed to the hydrofoil fin 3. Forces acting on the wings 5 and 6 are supported via the connecting rod 4 in the receptacle 10 against the hydrofoil fin 3.

Figure 3:
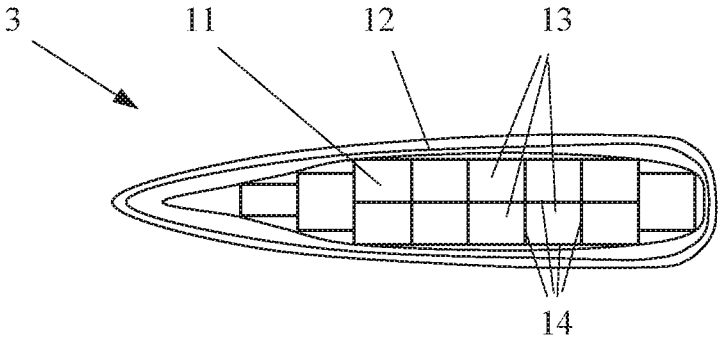

Having regard to a high flexural and torsional rigidity and a low component weight, the hydrofoil fin 3 has a very lightweight, nevertheless rigid core portion 11, which is encapsulated by an outer shell 12 of a multilayer fiber composite material, for example, carbon fiber reinforced plastic (CFRP) or glass fiber reinforced plastic (GRP). The outer shell 12 permits an aerodynamic design of the cross-sectional profile as shown in FIG. 3.

Figure 4:
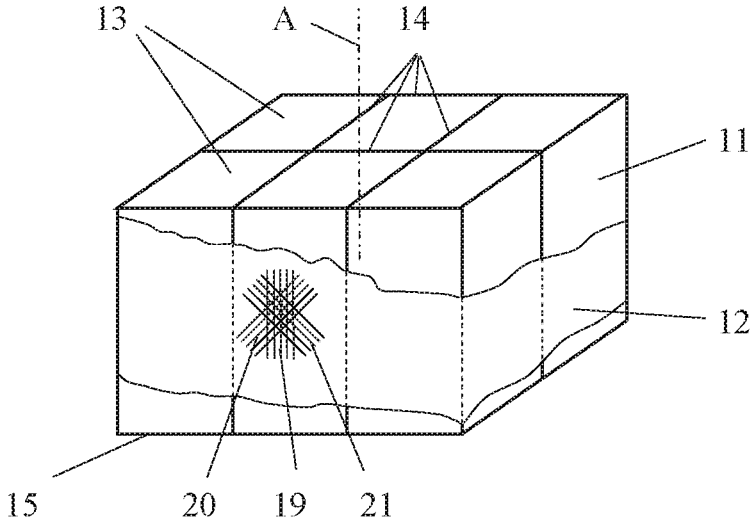

The core portion 11 of the fin hydrofoil 3 consists of a plurality of torsion boxes 13, which give the hydrofoil fin 3 high rigidity. These torsion boxes 13 each have walls made of a multilayer fiber composite material, in particular carbon fiber reinforced plastic (CFRP) or glass fiber reinforced plastic (GRP). As shown in FIGS. 3 and 4 the torsion boxes 13 are arranged such that each of the four walls 14 of such torsion box 13 are parallel to the longitudinal direction A of the hydrofoil fin 3. The number of torsion boxes can optionally also be reduced to a single torsion box. However, a larger number is better suited for a high bending and torsional stiffness.

Figure 5:
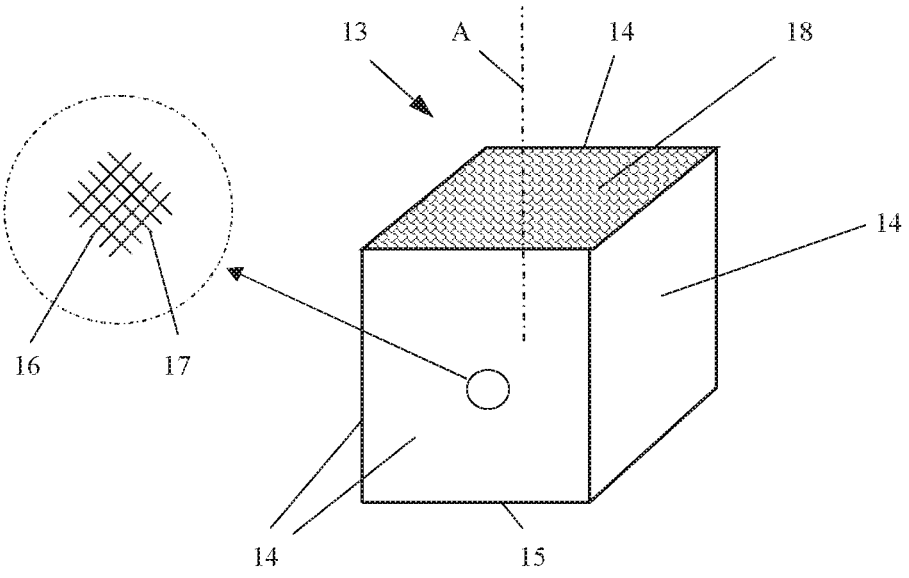

FIG. 5 shows a single torsion box 13 having two pairs of opposite walls 14. This torsion box 13 may optionally be closed by additional walls 15 in the longitudinal direction A.

At least the walls 14 extending in parallel to the longitudinal direction A each have at least one layer with a direction of fibers 16 (fiber flow), which is inclined to the longitudinal direction A of the hydrofoil fin 3 by a first angle $\alpha 1$ of preferably 45°. The direction of fibers 17 (fiber flow) in at least one other of the layers is inclined to the longitudinal direction A of the hydrofoil fin 3 by a second angle $\alpha 2$ of preferably −45° so that the respective fibers cross each other. Similarly, the additional walls 15 may have layers with intersecting fiber directions.

In particular, layers with positive and negative angles $\alpha 1$ and $\alpha 2$ to the longitudinal direction A may be arranged directly one after the other and alternately on the torsion boxes 13.

The torsion boxes 13 may each be filled with a foam material 18, as shown in FIG. 5. However, it is also possible to form some or all of torsion boxes 13 as hollow chambers.

In particular, torsion boxes 13 can be constructed as wrapped foam profiles with crisscross fiber orientation, wherein the respective foam material serves as a winding core.

The torsion boxes 13 are arranged in a bundled manner in the core portion of the hydrofoil fin 3, so that the walls 14, 15 rest against one another. This bundle is enclosed by the outer shell 12, which in turn also consists of a multi-layer fiber composite material.

FIG. 3 shows by way of example only and explicitly without limitation thereto one arrangement of torsion boxes in two rows. The number of rows can also be smaller or larger. In addition, torsion boxes with different cross-sections may be employed in order, for example, to better adapt to a desired cross-sectional profile. Basically, it is also possible to refrain from an arrangement in rows.

In contrast to the torsion boxes 13, the outer shell 12 comprises on one or more layers having a fiber direction 19 (fiber flow) in the longitudinal direction A of the hydrofoil fin 3 as indicated in FIG. 4. Between such layers with a fiber direction 19 parallel to the longitudinal direction A further layers can be provided, the fiber directions 20 and 21 of which are angled to the longitudinal direction A, for example, by +/−45°, and cross each other.

With regard to a particularly rigid coupling to the board 2, the core portion 11 having the torsion boxes 13 may extend into the first end portion 7 of hydrofoil fin 3, i.e. in the illustrated embodiment into the flange-like extended mounting portion 9 or to a portion of the hydrofoil fin 3 that is received in a form-fitting manner by the board 2.

The stiffening of the core portion 11 preferably extends over the entire length of hydrofoil fin 3 in longitudinal direction A to the second end portion 8 at which the wings 5 and 6 are attached by means of the connecting rod 4.

The connecting rod 4 may, if an appropriate structure is not integrated in the hydrofoil fin 3 made of fiber composite material, be made of metal, preferably of steel, titanium or an aluminium alloy. It has a diameter in the range of about 10 to 25 mm, whereby the flow resistance in the water remains small. The length of the connecting rod 4 is preferably in the range of 400 to 900 mm. With regard to simple manufacture and assembly the connecting rod 4 can be formed with a constant diameter. However, it is also possible that only sections thereof, for example, the portion that is received by the holder 10, have a constant cross section.

The front wing 5 and the rear wing 6 are arranged one behind the other in the direction of travel and in each case releasably secured to one end of the connecting rod 4. In particular, the forward wing 5 is positioned at a front end portion and the rear wing 6 at a rear end portion of the connecting rod 4, so that in the direction of travel the front wing 5 is in front of the hydrofoil fin 3 and the rear wing 6 behind the hydrofoil fin 3.

The connecting rod 4 is detachably secured to the hydrofoil fin 3 and similarly the wings 5 and 6 are detachably secured to the connecting rod 4. In this way, connecting rods 4 of different lengths may be attached to the hydrofoil fin 3 to change the position of the wings 5 and 6. Furthermore, different front and rear wings 5 and 6 can be fixed to the connecting rod 4. The wings 5 and 6 may be made of fiber reinforced plastic or a composite multilayer material.

The above-described structure of the hydrofoil fin 3 provides a very rigid support of bending and torsional forces acting on the same and on the wings 5 and 6 against the board 2. This has an advantageous effect on the riding performance of during kite surfing and jet skiing.

The invention has been explained above with reference to one embodiment. However, it is not limited thereto but comprises all embodiments defined by the claims. In particular, individual technical features can also be combined with each other if this is not explicitly described, as long as such a combination is technically possible.

What is claimed is:

1. A hydrofoil fin (3) for attachment to a board (2), comprising:

a core portion (11) formed by a plurality of torsion boxes (13); and an outer shell made of a layered fiber composite material and surrounding the core portion (13) including said torsion boxes (13), wherein the torsion boxes (13) each have four walls (14) made of a layered fiber composite material and extending in longitudinal direction (A) of the hydrofoil fin (13), wherein the direction of the fibers (16) in at least one of the layers of the fiber composite material is at a first angle ($\alpha 1$) to the longitudinal direction (A) of the hydrofoil fin (13) and the direction of the fibers (17) in at least one other of the layers is at a second angle ($\alpha 2$) to the longitudinal direction (A) of the hydrofoil fin (3) so that the respective fibers cross each other.

2. The hydrofoil fin of claim 1, wherein layers with positive and negative angle of incidence ($\alpha 1$, $\alpha 2$) to the longitudinal direction (A) are arranged alternately.

3. The hydrofoil fin of claim 1, wherein one or more of the torsion boxes (13) are formed as hollow chambers.

4. The hydrofoil fin of claim 1, wherein one or more of the torsion boxes (13) are filled with a foam material (18).

5. The hydrofoil fin of claim 1, wherein one or more of the torsion boxes (13) are formed foam profiles that are wrapped by fiber layers with intersecting fibers.

6. The hydrofoil fin of claim 1, wherein at least two torsion boxes (13) are provided having a different cross-section in a plane transverse to the longitudinal direction (A) of the hydrofoil fin (13).

7. The hydrofoil fin of claim 1, wherein the outer shell (12) is made of a multi-layer fiber composite material, wherein at least one layer has a fiber direction (19) in longitudinal direction (A) of the hydrofoil fin.

8. The hydrofoil fin of claim 7, wherein the outer shell (12) further comprises additional layers having fiber directions (20, 21) which are angled to the longitudinal direction and cross each other.

9. The hydrofoil fin of claim 1, further comprising a mounting portion (10) for coupling to a board (2), wherein the core portion (11) having the torsion boxes (13) extends into the mounting portion (10).

10. A hydrofoil comprising a hydrofoil fin (3) according to claim 1 further comprising:

a first end portion (7) for attachment to a board (2), and a front wing (5) and a rear wing (6), which in the direction of travel of the board (2) are disposed one behind the other and are connected to a second end portion (8) of the hydrofoil fin (3).

* * * * *